US005384985A

United States Patent [19]

Jacobsson

[11] Patent Number: 5,384,985

[45] Date of Patent: Jan. 31, 1995

[54] PNEUMATIC ROTATION GRINDER

[75] Inventor: Rolf A. Jacobsson, Saltsjö-Boo, Sweden

[73] Assignee: Atlas Copco Tools AB, Nacka, Sweden

[21] Appl. No.: 254,497

[22] Filed: Jun. 6, 1994

Related U.S. Application Data

[63] Continuation of Ser. No. 73,769, Jun. 8, 1993, abandoned.

[30] Foreign Application Priority Data

Jun. 29, 1992 [SE] Sweden ..... 9201990

[51] Int. Cl.[6] ..... B24B 23/00; B24B 55/04

[52] U.S. Cl. ..... 451/344; 451/451

[58] Field of Search ..... 51/170 R, 170 PT, 170 T, 51/268, 134.5 F

[56] References Cited

U.S. PATENT DOCUMENTS 4,558,539 12/1985 Hansson ..... 51/170 R
4,924,635 5/1990 Rudolf et al. ..... 51/170 R

FOREIGN PATENT DOCUMENTS 0126641 11/1984 European Pat. Off. .
0322626 7/1989 European Pat. Off. .
0457740 11/1991 European Pat. Off. .
2314022 1/1977 France .
3135820 1/1985 Germany .
3919649 12/1990 Germany ..... 51/170 R
9200834 1/1992 WIPO .
9219423 11/1992 WIPO .

OTHER PUBLICATIONS

Luna Katalog, published by Luna AB, Sweden, 1986, cover and title pages and pages 1231, 1308 and 1744.

*Primary Examiner*—Bruce M. Kisliuk
*Assistant Examiner*—Derris Holt Banks
*Attorney, Agent, or Firm*—Frishauf, Holtz, Goodman & Woodward

[57] ABSTRACT

A pneumatic rotation grinder comprises a housing (10) with a throttle valve controlled air inlet passage, a rotation motor drivingly connected to an output shaft (12) intended to carry a grinding tool, a safety guard (17) adjustably supported on the housing (10) in a coaxial disposition relative to the output shaft (12), and a lock device (26–28, 33–38) for arresting the safety guard (17) in desired angular positions relative to the housing (10). The lock device (26–28, 33–38) comprises both a latch (26–28) for positive coupling by engagement of teeth (26, 28) of the safety guard (17) relative to the housing (10), and a pressure air activated clamping device (33–38) for frictional arresting of the safety guard (17) relative to the housing (10).

6 Claims, 2 Drawing Sheets

PNEUMATIC ROTATION GRINDER

This application is a continuation of application Ser. No. 08/073,769, filed Jun. 8, 1993, now abandoned.

BACKGROUND OF THE INVENTION

This invention relates to a pneumatic rotation grinder which comprises a housing with a pressure air inlet passage and a manually operable throttle valve, a rotation motor drivingly connected to an output shaft on which a grinding tool is attachable, a safety guard adjustably supported on the housing in a coaxial disposition relative to the output shaft, and a lock means located between the safety guard and the housing and arranged to arrest the safety guard in desired angular positions relative to the housing.

A prior art rotation grinder of the above type is described in E.P. 0 322 626 (corresponding to U.S. Pat. No. 4,924,634). This previously known tool comprises a safety guard that is rotationally locked to the tool housing by means of a latch element in selective cooperation with a number of teeth or holes on the safety guard.

A drawback inherent in this known concept is that the inevitable play, although small, existing between the safety guard and the housing as well as between the latch element and the teeth or holes in the safety guard will cause a rattling of the latter during operation of the tool. This rattling will in turn result not only in an annoying noise but after some time also in a deformation of the latch element and the cooperating teeth or holes, which will increase the rattling, and so on. This problem will be significant if the safety guard is of the vibration damping type having additional weights supported thereon.

The above problem is solved by the invention.

A preferred embodiment of the invention is described below in detail with reference to the accompanying drawings.

DETAILED DESCRIPTION

Figure 1:
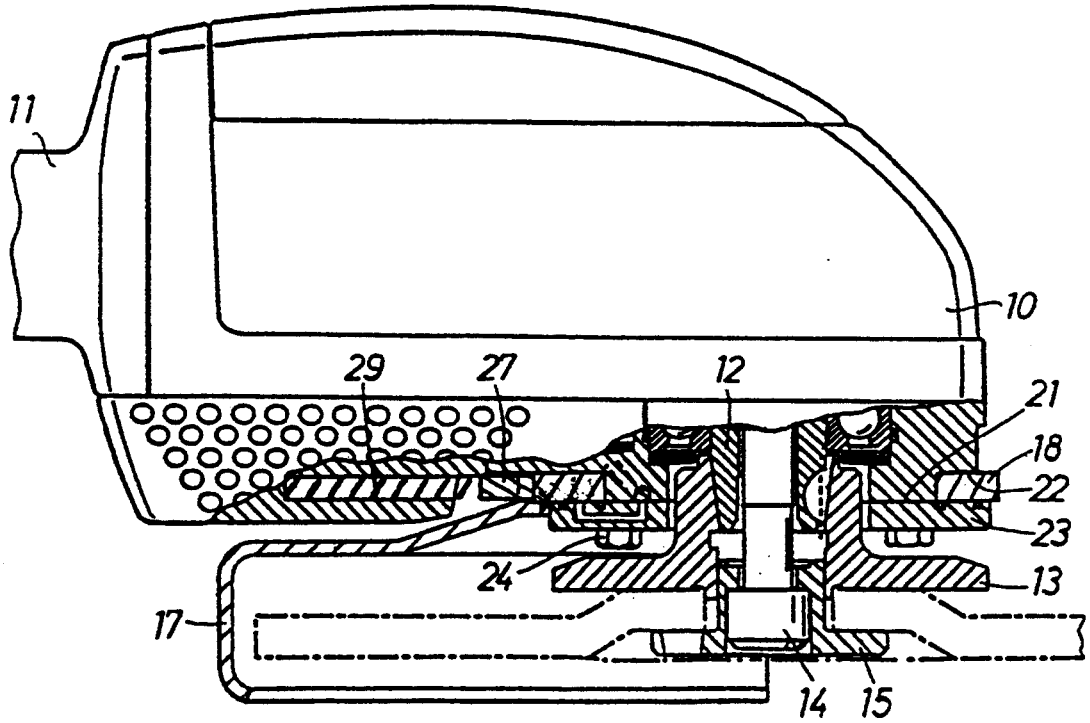
FIG. 1 shows a side view, partly in section, of a rotation grinder according to the invention.

The pneumatic rotation grinder shown in the drawing figures comprises a housing 10 formed with a handle 11 and containing a pneumatic rotation motor (not shown). The latter is drivingly coupled to an output shaft 12 which carries grinding wheel mounting means in the form of a flanged hub 13, a center bolt 14 and a washer 15.

Pressure air is supplied to the motor in a common way through an inlet passage and a throttle valve in the handle 11. As this is a common feature of most pneumatic tools, a detailed illustration and description thereof has not been included in this specification.

A safety guard 17 of pressed steel has a welded-on mounting ring 18 with flat end surfaces 19, 20 and is rotationally supported on a neck portion 21 on the housing 10. This neck portion 21 is concentric with the output shaft 12 and is surrounded by a flat ring surface 22 on the housing 10. The neck portion 21 has an axial extent substantially equal to the thickness of the mounting ring 18. The latter is axially locked by a retaining ring 23 which is secured to the housing 10 by a number of screws 24 and which has a flat annular surface 25 for guiding cooperation with the annular surface 20 of the mounting ring 18.

Figure 3:
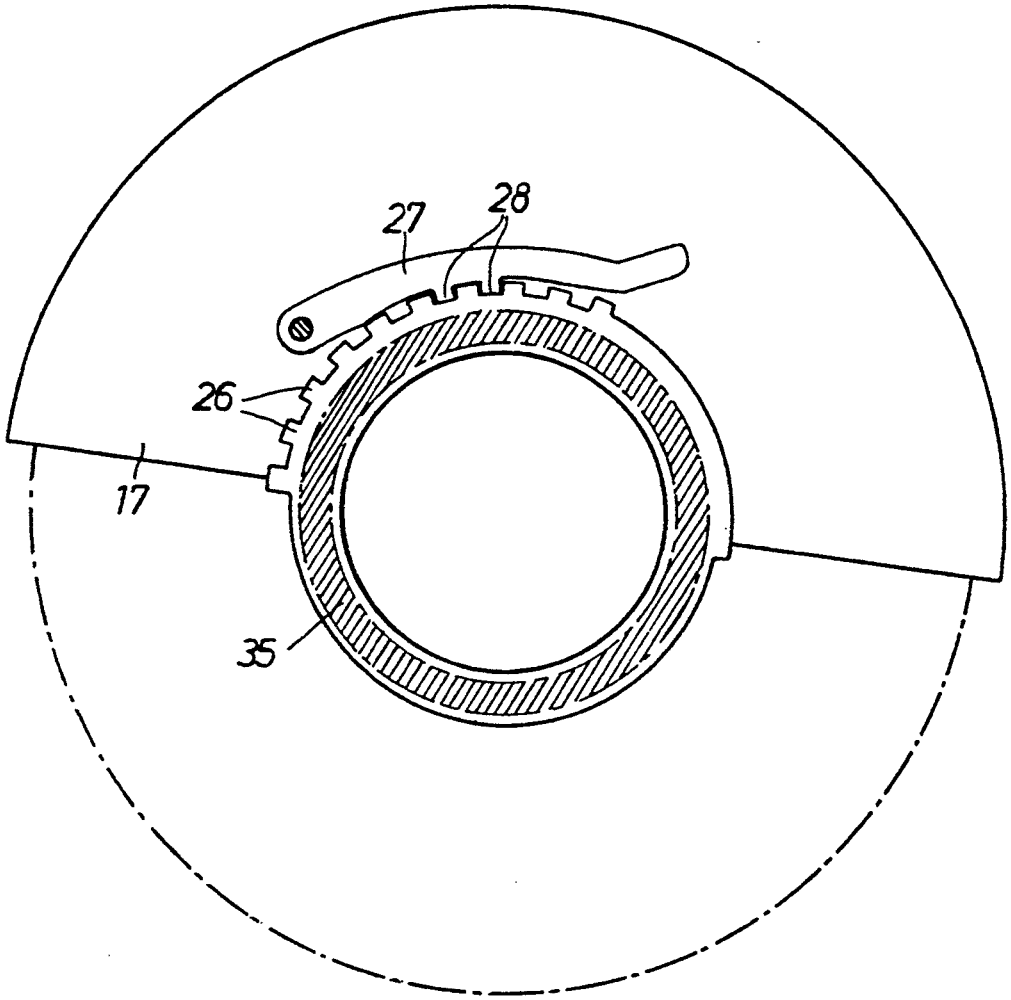
FIG. 3 shows a top view of the safety guard.

At its periphery, the mounting ring 18 is provided with a row of teeth 26, and a latch lever 27 pivotally mounted on the housing 10 is formed with teeth 28 for locking cooperation with the safety guard teeth 26. See FIG. 3. As being illustrated in FIG. 1, the latch lever 27 is biassed by a spring 29 towards its teeth engaging position.

Figure 2:
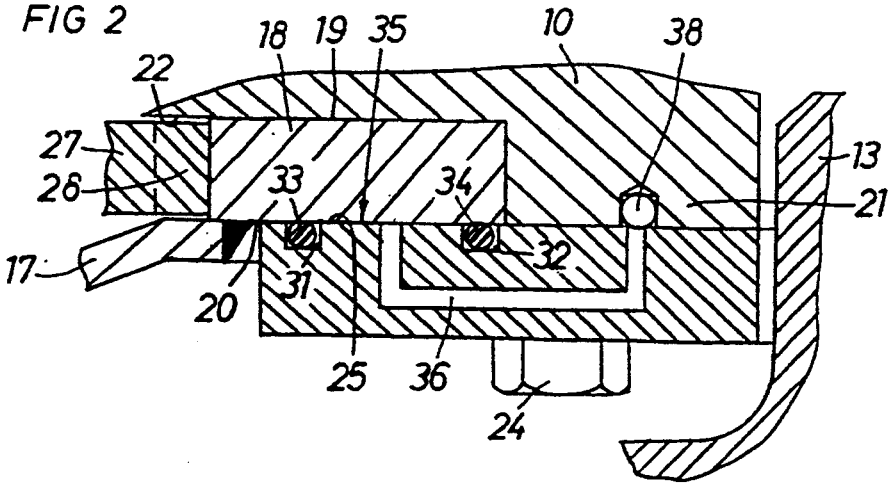
FIG. 2 shows, on a larger scale, a fraction of the section in FIG. 1.

As illustrated in FIGS. 1 and 2, the retaining ring 23 is provided with two concentric circular grooves 31, 32 supporting O-rings 33 and 34, respectively. Both of these O-rings 33, 34, are in sealing contact with the end surface 20 of the mounting ring 18 and form between them an annular sealed-off area 35, which is illustrated by a hatched surface in FIG. 3.

A U-shaped passage 36 in the retaining ring 23 communicates pressure air from a passage 38 in the housing 10 to the ring area 35 between the O-rings 33, 34. The passage 38 communicates with the air inlet passage of the tool, downstream of the throttle valve.

The operation order of the adjustable safety guard mounting is the following:

In the rest position of the tool, the safety guard 17 is arrested against rotation by the positive interengagement of the teeth 28 on the latch lever 27 and the teeth 26 on the mounting ring 18. By maneuvering the latch lever 27 against the bias force of the spring 29, the locking interengagement of the teeth 28 and 26 is broken and the safety guard 17 is released for angular adjustment.

During operation of the tool, the safety guard 17 is arrested against rotation not only by the teeth 26, 28, but is frictionally arrested in that the annular surface 19 of the mounting ring 18 is axially clamped against the annular surface 22 on the housing 10. This clamping action is obtained by pressure air supplied through the passage 38 and the U-shaped passage 36 in the retaining ring 23 to the annular pressure area 35 between the O-rings 33, 34.

The frictional arresting of the safety guard 17 is of such a strength that the positive tooth locking is superfluous as long as the throttle valve is open and the motor is powered. However, before opening the throttle valve to start the motor, i.e. when applying the tool to the workpiece, as well as immediately after the throttle valve is closed, i.e. while the grinding wheel is still rotating, it is important that the safety guard 17 is safely maintained in its desired position. This purpose is served by the positive locking obtained by the latch lever teeth engagement with the teeth on the safety guard.

By the above described arrangement it is possible to have a fairly light fitting of the safety guard mounting ring 18 between the retaining ring 23 and the housing 10 so as to make an adjustment of the safety guard 17 easy once you have released the latch lever 27. Any occuring rattling of the safety guard 17 relative to the housing 10 during operation of the tool is prevented by the pressure clamping means formed by the O-rings 33, 34 and the pressure air supply passages 36, 38.

I claim:

1. Pneumatic rotation grinder, comprising:

a housing (10) having a pressure air inlet passage and a manually operable throttle valve, a rotation motor, an output shaft (12) driven by said motor and arranged to carry a grinding tool, a safety guard (17, 18) adjustably supported on said housing (10) in a coaxial disposition relative to said output shaft (12), and lock means located between said safety guard (17) and said housing (10) and arranged to arrest said safety guard (17, 18) in desired angular positions relative to said housing (10), said lock means (26–28, 33–38) comprising a pressure air operated clamping means (33–38) for frictional coupling of said safety guard (17, 18) to said housing (10).

2. Rotation grinder according to claim 1, wherein said clamping means (33–38) comprises a pneumatic actuator, which via an air supply passage (38) in said housing (10) is connected to said air inlet passage downstream of said throttle valve.

3. Rotation grinder according to claim 2, wherein said clamping means (33–38) comprises:

a first annular surface (25) associated with said housing (10), a second annular surface (20) on said safety guard (17, 18), said first and second annular surfaces (25, 20) being disposed concentrically with each other as well as with said output shaft (12), and two concentrically disposed O-rings (33, 34) of different diameters located between said first and second annular surfaces (25, 20) and defining therebetween an annular area (35), which is pressurized through said air supply passage (38) as said throttle valve is open.

4. Rotation grinder according to claim 1, wherein said lock means (26–28, 33–38) further comprises latch means (26–28) for positively locking said safety guard (17, 18) to said housing (10).

5. Rotation grinder according to claim 2, wherein said lock means (26–28, 33–38) further comprises latch means (26–28) for positively locking said safety guard (17, 18) to said housing (10).

6. Rotation grinder according to claim 3, wherein said lock means (26–28, 33–38) further comprises latch means (26–28) for positively locking said safety guard (17, 18) to said housing (10).

* * * * *